US007582094B2

(12) United States Patent
Dorber et al.

(10) Patent No.: US 7,582,094 B2
(45) Date of Patent: Sep. 1, 2009

(54) ATTACHMENT FOR AN EPILATOR

(75) Inventors: Ralf Dorber, Oberursel (DE); Pedro Sanchez-Martinez, Kronberg (DE)

(73) Assignee: Braun GmbH, Kronberg (DE)

( * ) Notice: Subject to any disclaimer, the term of this patent is extended or adjusted under 35 U.S.C. 154(b) by 681 days.

(21) Appl. No.: 11/150,911

(22) Filed: Jun. 13, 2005

(65) Prior Publication Data

US 2005/0288687 A1 Dec. 29, 2005

Related U.S. Application Data

(63) Continuation of application No. PCT/EP03/12788, filed on Nov. 15, 2003.

(30) Foreign Application Priority Data

Dec. 14, 2002 (DE) ..... 102 58 518

(51) Int. Cl.
*A61B 17/50* (2006.01)

(52) U.S. Cl. ..... 606/133

(58) Field of Classification Search ..... 606/131, 606/133; 30/537, 539, 540
See application file for complete search history.

(56) References Cited

U.S. PATENT DOCUMENTS

| | | | | |
|---|---|---|---|---|
| 4,960,422 | A * | 10/1990 | Demeester | 606/133 |
| 5,084,056 | A * | 1/1992 | Eckel et al. | 606/133 |
| 5,190,559 | A * | 3/1993 | Gabion et al. | 606/133 |
| 6,261,301 | B1 * | 7/2001 | Knesch et al. | 606/131 |

FOREIGN PATENT DOCUMENTS

| | | |
|---|---|---|
| JP | 07289350 | 11/1995 |
| WO | WO98/05234 | 2/1998 |

* cited by examiner

*Primary Examiner*—Todd E. Manahan
*Assistant Examiner*—Leander Taylor, III
(74) *Attorney, Agent, or Firm*—Fish & Richardson P.C.

(57) ABSTRACT

A device for use on an epilator having a drivable epilation head with a plurality of clamping elements. The device can be adapted to cover at least one clamping to prevent the clamping element from trapping hairs.

31 Claims, 3 Drawing Sheets

ATTACHMENT FOR AN EPILATOR

CROSS-REFERENCE TO RELATED APPLICATIONS

This is a continuation of PCT application No. PCT/EP2003/012788, filed on Nov. 15, 2003, which claims priority to German Patent Application No. 102 58 518.0, filed on Dec. 14, 2002, each of which is incorporated herein by reference in its entirety.

TECHNICAL FIELD

This invention relates to an attachment for an epilator.

BACKGROUND

JP 7-289350 A discloses an attachment for use on an epilator. The attachment is constructed as either a rigid protective cap for covering the ends of the epilating cylinder or a two-part device slidably guided on the housing of the epilator. The two-part version of this device possesses masking elements which are arranged laterally adjacent to the actual epilating cylinder in the area of the bearing cheeks so that the full width of the epilator may be utilized. The masking elements may be moved towards each other so that, similar to the one-piece protective cap, the end regions of the epilating cylinder are covered. Accordingly, individual clamping elements on the epilator whose paths of motion lie in the area of the ends can be covered in such manner that they are unable to receive hairs for plucking. According to JP 7-289350 A, the subjective perception of pain is reduced by decreasing the number of clamping elements involved in the plucking operation, because fewer plucking events per unit of time take place. However, often times the active epilation width of the appliance is reduced by a significant amount, making it necessary for the user to repeatedly shift the epilator sideways during use.

SUMMARY

In one aspect, a device for use on an epilator is adapted to effect the deactivation of plucking or clamping elements on an epilator head. The reduction of the number of plucking events per unit of time is distributed over the full width of the epilation head. Accordingly, the effective width of the epilation head can be maintained or reduced only insignificantly.

In some embodiments, the device is constructed as a strip-shaped cover having a plurality of apertures between which a respective masking strip is formed. By arranging these apertures or masking strips in an inclined relationship to the paths of motion of the clamping elements, a particularly sturdy construction of this cover can be achieved. Thus, the masking strips can be built with a very thin wall thickness, so that the clamping elements, in spite of the presence of the masking strips, can be held very close to the skin and hence to the hair roots. This arrangement can help to ensure that hairs are extracted with little pain to the user.

In some embodiments, the device is constructed as a removable attachment, enabling epilation to be carried out with the same appliance on less sensitive regions of the skin without the device attached and, thus, with increased efficiency. For the epilation of sensitive skin regions, the device can be attached as an accessory in order to reduce the number of active clamping elements and thus the pain experienced by the user.

In some embodiments, the device is integrated in the epilation head as a permanent fixture. Advantageously, such a system can allow for the manufacture of epilation heads with the same number of clamping elements but varying levels of efficiency and pain reduction. This is particularly suitable in cases where the epilator comes with at least two detachable and interchangeable epilation heads, of which one has the device of the invention integrated in it. In this way, an epilation system can be provided which enables the user to choose between maximum efficiency and maximum pain reduction by using the appropriate epilation head.

In some embodiments the device may be constructed as an arcuate foil. Advantageously, the foil can be relatively thin, thereby avoiding a widening of the distance between the clamping elements and the skin to be epilated. In some embodiments, the foil may be held in a mounting frame. This construction can be advantageous, particularly in terms of handling.

Advantageously, the above-described attachment for an epilator can cause an appreciable reduction of the pain felt by the user without incurring a reduction of the active epilation width of the appliance. At the same, the device can be easily manufactured and used. In particular, it should be possible for the accessory to be manufactured at low cost without necessitating any changes to the epilator.

Other features and advantages of the invention will be apparent from the description, drawings, and claims.

DESCRIPTION OF DRAWINGS

Like reference symbols in the various drawings indicate like elements.

DETAILED DESCRIPTION

Figure 1:
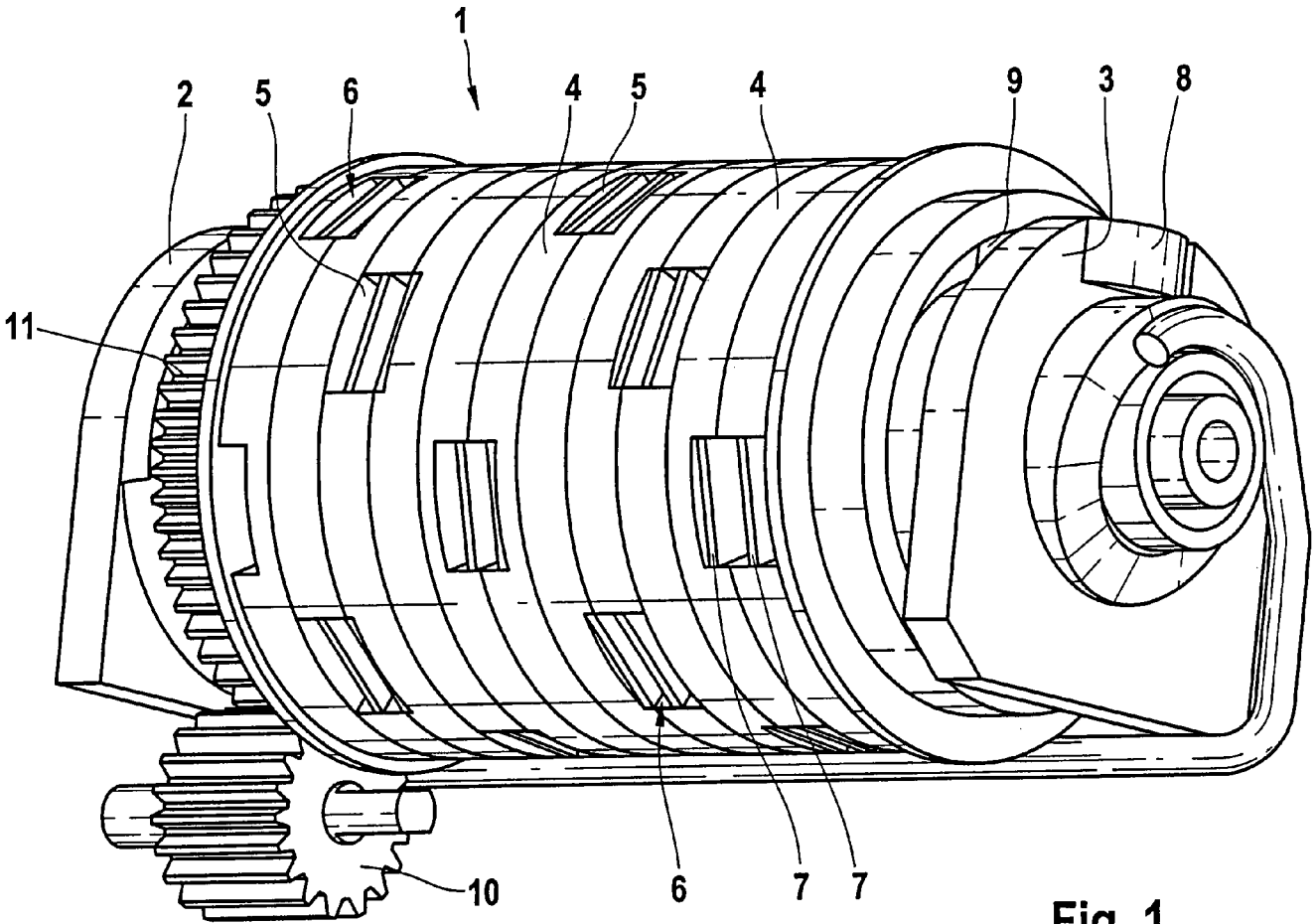
FIG. 1 is a schematic view of an embodiment of an epilation head.

In one embodiment, the device may be constructed as an attachment for use on an epilation head of the type shown in FIG. 1. The epilation head 1 includes an epilating cylinder carried in end cheeks 2 and 3 for rotation about a longitudinal axis. Rotation of the epilation head 1 can be effected by a drive pinion 10 of a motor (not shown) which meshes with an annular gear 11 provided in the end area of the epilation head 1 adjoining the end cheek 2.

As shown in FIG. 1, the epilation head 1 contains multiple clamping elements 6. The epilation head 1 is composed of multiple disk elements 4 having radially extending cutouts 5 each accommodating a clamping element 6. Each clamping element 6 comprises two clamping blades 7 that are moved towards and away from each other by a control mechanism. The end cheeks 2, 3 contain a respective cam element 8 which can be constructed as a roller. During rotation of the epilating cylinder 1, the cam element 8 exerts pressure on pushrods 9 which are associated with each clamping element 6, thereby closing the associated clamping element 6. Hairs which are present between the clamping blades 7 as the clamping blades are closed can be trapped between the clamping blades 7 and extracted from the skin due to rotation of the epilation head. As the rotation of the epilation head continues, the extracted hairs can be ejected due to centrifugal forces.

The epilation head 1 is comprised of a total of eleven disk elements 4. Between each disk element, two clamping blades 7 are arranged in the associated cutouts 5. Hence 10 pairs of clamping blades are provided. These pairs of clamping blades are circumferentially spaced apart by 36° of arc and extend through the disks 4 along the disks' cutouts 5. The ends of two cooperating clamping blades 7 each form two diametrically opposite clamping elements 6. Accordingly, the structural design of the epilation head is similar to the one disclosed in WO 98/05234.

With the epilator in operation, two clamping elements 6 close at the same time when they register with the two cam elements 8 arranged in the end cheeks 3 and 2, respectively, during rotation. The pushrods 9 associated with the clamping elements are urged inward, with their line of movement running parallel to the axis of rotation of the epilation head 1. Thus, on each rotation through 36°, clamping operations take place at two locations on the surface of the epilation head.

Figure 2:
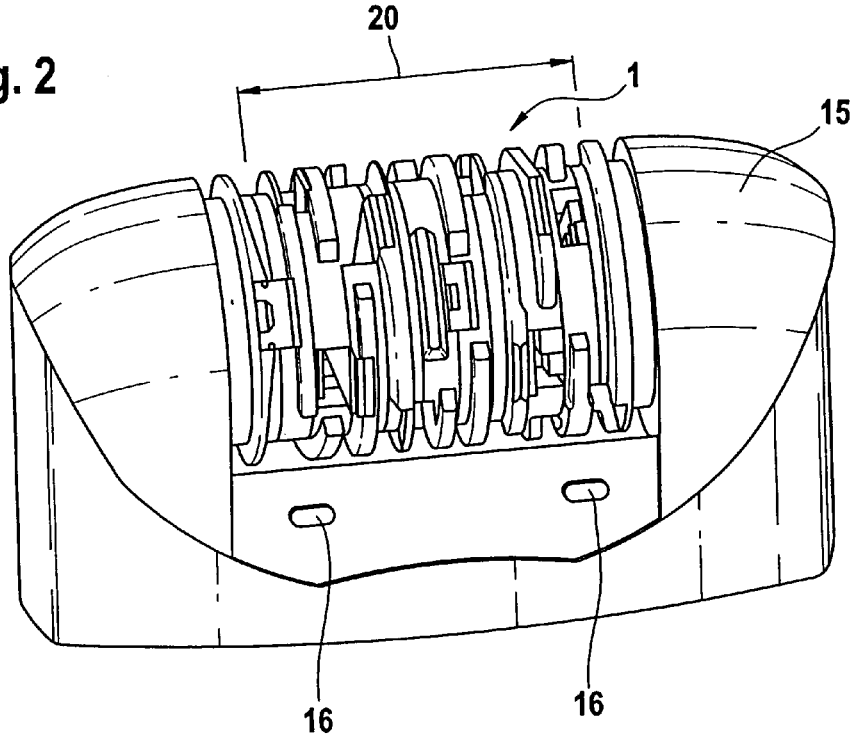
FIG. 2 is a perspective view of an embodiment of an epilation head.
Figure 3:
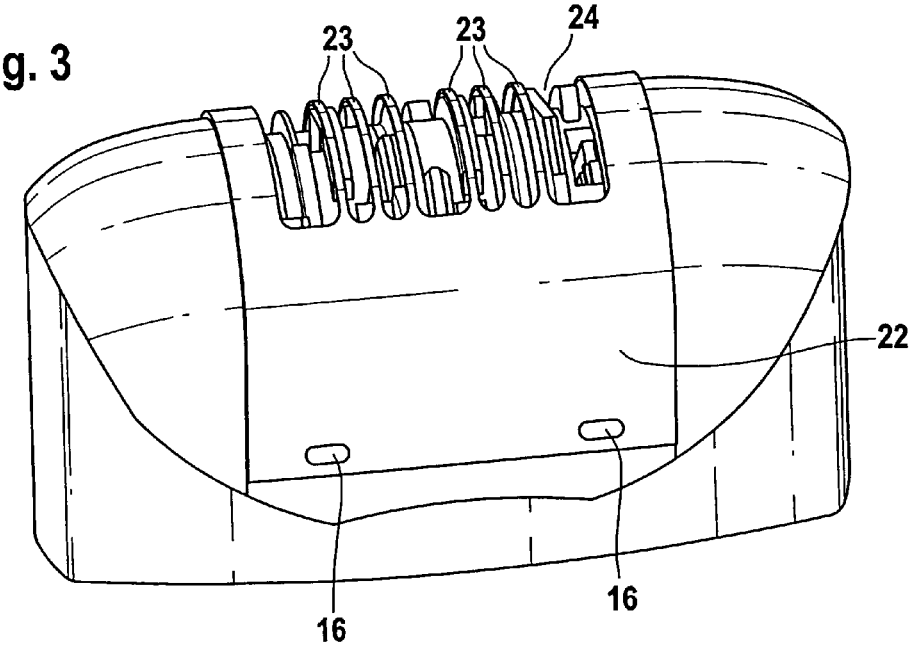
FIG. 3 is a perspective view of an embodiment of an epilation head with the attachment.

FIGS. 2 and 3 show the upper part of an epilator in an embodiment in which the actuating elements and bearings of the epilating cylinder are concealed by a housing 15. For clarity, the lower part of this housing which accommodates the drive mechanism, the power supply and the switches for turning the epilator on and off is not shown. Two button-type fastening elements 16 are arranged on the housing 15 in the region below the epilating cylinder 1. These fastening elements 16 are laterally spaced from each other and appear on both the front side shown in FIG. 2 and the rear side of the housing 15. Their lateral distance corresponds approximately to the epilation width 20 of the epilation head 1. This width is dictated by the relative distance of the two outermost clamping elements 6 along the axis of rotation of the epilation head. The circular paths of motion of the clamping elements 6 during rotation of the epilation head run in a plane normal to the axis of rotation of the epilation head. In the embodiment shown, there are ten paths of motion along each of which two clamping elements move. On each path of motion, the clamping elements 6 close twice per revolution.

In order to reduce the sense of pain during epilation, the cover device 22 may be attached to the epilator or its housing 15 so as to encompass the epilation head 1. FIG. 3 shows an epilator with the cover device 22 attached to it. The cover device 22 is locked onto the housing 15 using fastening elements 16.

Figure 4:
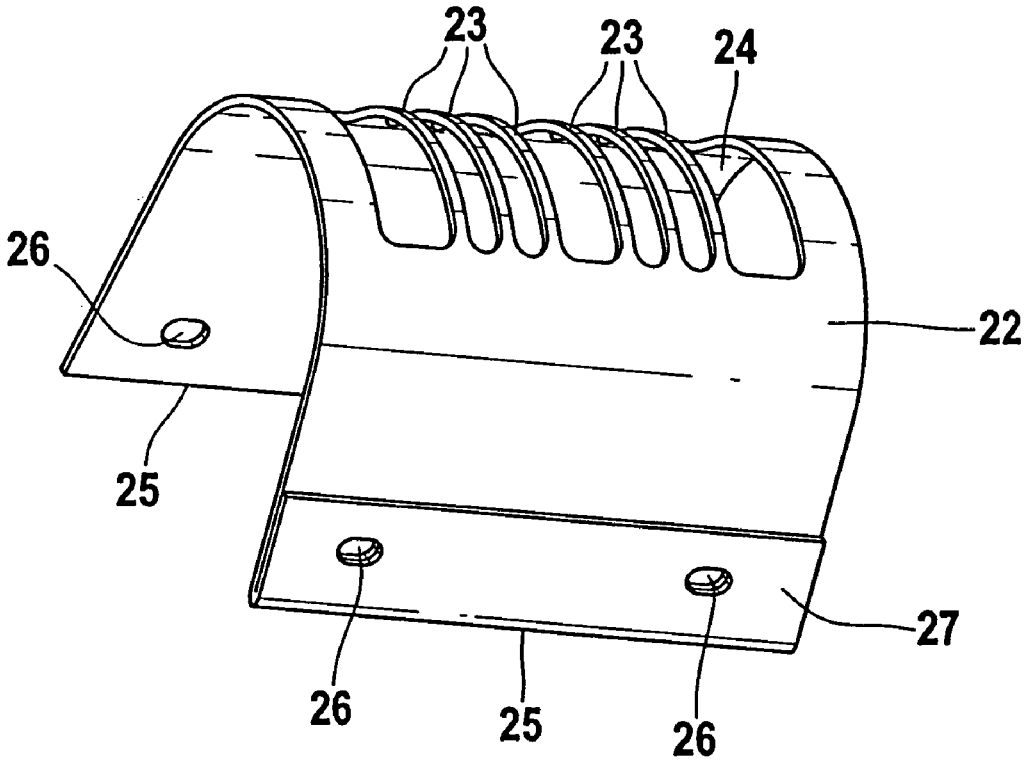
FIG. 4 is a perspective view of an embodiment of an attachment for use on the epilation head of FIG. 2.

FIG. 4 shows an embodiment in which the cover device 22 takes the form of a bent thin-walled foil having in its center region a series of apertures 24 separated from each other by areas of material which form respective masking strips 23. When the cover device 22 is attached to the epilator, as shown in FIG. 3, the masking strips 23 cover individual paths of motion of the clamping elements 6, which can help to prevent the associated clamping elements from grasping hairs. Consequently, the number of simultaneous plucking events can be reduced. In the region of the narrow ends 25 the cover device 22 has two cutouts 26 which allow for locking engagement with the fastening elements 16. This enables the cover device to be constructed as a component suitable for mounting and demounting with reduced effort by the user. By suitably arranging or spacing the masking strips 23, a defined number—in the present case six of ten—of paths of motion of the clamping elements 6 can be deactivated while the width of epilation 20 remains unchanged.

As shown in FIG. 4, mounting frames 27 can be provided in the area of the narrow ends 25 of the attachment. This facilitates the attachment of the cover device 22 to the epilator. However, it is also possible for the mounting frame 27 to be constructed as an arched two-dimensional frame which follows the outer contour of the epilation head 1 and encompasses both the long and short ends of the cover device 22. The masking strips 23 may also be arranged to extend at an inclination relative to the paths of motion of the clamping elements, intersecting these paths of motion in the area where the respective clamping elements 6 close. The inclined configuration of the masking strips can enhance the stability of the entire cover device 22, allowing for a particularly thin-walled construction.

Other embodiments are within the scope of the following claims.

What is claimed is:

1. An epilator system, comprising:

an epilator device having a drivable epilation head with a plurality of clamping elements distributed on its working surface and configured to move along paths of motion when the epilation head is driven, and with actuating members designed to move the clamping elements into relative clamping contact in a plucking zone in which some of the clamping elements are exposed in order to trap hairs between the some of the clamping elements and extract the trapped hairs, and with at least one control member adapted to control the actuating members; and an attachment secured to the epilator device in a manner such that the attachment at least partially covers at least one of the paths of motion in the plucking zone to prevent hairs from being clamped between the clamping elements that move along the at least one of the paths of motion, the at least one of the paths of motion lying between two other paths of motion that are exposed in the plucking zone and whose associated clamping elements are positioned to trap hairs.

2. The epilator system of claim 1, wherein the attachment comprises a cover having a plurality of apertures separated from each other by masking strips.

3. The epilator system of claim 2, wherein the apertures extend in an inclined relationship to the paths of motion of the clamping elements.

4. The epilator system of claim 2, wherein the masking strips extend in an inclined relationship to the paths of motion of the clamping elements.

5. The epilator system of claim 1, wherein the attachment is constructed to be removably attached to the epilation head.

6. The epilator system of claim 1, wherein the attachment comprises a foil.

7. The epilator system of claim 1, wherein the attachment comprises an arcuate foil.

8. The epilator system of claim 7, wherein the foil is held in a mounting frame.

9. The epilator system of claim 8, wherein the attachment comprises a cover having a plurality of apertures separated from each other by masking strips.

10. The epilator system of claim 9, wherein the attachment is constructed to be removably attached to the epilator device.

11. The epilator system of claim 1, wherein the attachment is permanently affixed to the epilation head.

12. The epilator system of claim 1, wherein the epilation head is configured to rotate about an axis of rotation to move the clamping elements along the paths of motion, and the paths of motion are circular and run in a plane substantially perpendicular to the axis of rotation.

13. The epilator system of claim 1, wherein each clamping element comprises two clamping blades configured to be moved toward and away from one another.

14. An epilator system, comprising:

an epilator device having a drivable epilator head with first clamping elements configured to move along first paths of motion and second clamping elements configured to move along second paths of motion when the epilation head is driven; and an epilator attachment comprising a frame that is attached to the epilator device; and a plurality of strips extending from a first portion of the frame to a second portion of the frame, the plurality of strips together with the first and second portions of the frame defining a plurality of apertures that are positioned over the first paths of motion such that the plurality of apertures allow the first clamping elements to pluck hair during use, and the plurality of strips positioned over the second paths of motion such that the plurality of strips substantially prevent the second clamping elements from plucking hair during use.

15. The epilator system of claim 14, wherein the frame is releasably attachable to the epilator device.

16. The epilator system of claim 14, wherein the epilator attachment is attachable to the epilator head of the epilator device.

17. The epilator system of claim 14, wherein the plurality of strips extend approximately along the second paths of motion of the second clamping elements.

18. The epilator system of claim 14, wherein the epilator attachment is permanently affixed to the epilator head of the epilator device.

19. The epilator system of claim 18, wherein the epilator head is releasably attached to a housing of the epilator device.

20. The epilator system of claim 14, wherein the epilator head is configured to rotate about an axis of rotation to move the first and second clamping elements along the first and second paths of motion, and the first and second paths of motion are circular and run in a plane substantially perpendicular to the axis of rotation.

21. The epilator system of claim 14, wherein the epilator head is configured to rotate about an axis of rotation to move the first and second clamping elements along the first and second paths of motion, the strips are elongate, and a length of each elongate strip extends substantially perpendicular to the axis of rotation.

22. The epilator system of claim 14, wherein each of the first and second clamping elements comprises two clamping blades configured to be moved toward and away from one another.

23. An epilator system, comprising:

an epilator device having a drivable epilator head with first clamping elements configured to move along first paths of motion and a second clamping element configured to move along a second path of motion when the epilation head is driven; and an epilator attachment that is attached to the epilator device, the epilator attachment defining first and second apertures, a first strip portion of the epilator attachment extending between the first and second apertures, the first and second apertures positioned over the first paths of motion such that the apertures allow the first clamping elements to pluck hair during use, and the first strip portion of the epilator attachment positioned over the second path of motion such that the first strip portion of the epilator attachment substantially prevents the second clamping element from plucking hair during use.

24. The epilator system of claim 23, wherein the epilator attachment is releasably attachable to the epilator device.

25. The epilator system of claim 23, wherein the epilator attachment is attached to the epilator head of the epilator device.

26. The epilator system of claim 23, wherein the plurality of strips extend approximately along the second path of motion.

27. The epilator system of claim 23, wherein the epilator attachment is permanently affixed to the epilator head of the epilator device.

28. The epilator system of claim 27, wherein the epilator head is releasably attached to a housing of the epilator device.

29. The epilator system of claim 23, wherein the epilator head is configured to rotate about an axis of rotation to move the first and second clamping elements along the first and second paths of motion, and the first and second paths of motion are circular and run in a plane substantially perpendicular to the axis of rotation.

30. The epilator system of claim 23, wherein the epilator head is configured to rotate about an axis of rotation to move the first and second clamping elements along the first and second paths of motion, the first strip portion is elongate, and a length of the first strip portion extends substantially perpendicular to the axis of rotation.

31. The epilator system of claim 23, wherein each of the first and second clamping elements comprises two clamping blades configured to be moved toward and away from one another.

* * * * *

UNITED STATES PATENT AND TRADEMARK OFFICE

CERTIFICATE OF CORRECTION

PATENT NO. : 7,582,094 B2
APPLICATION NO. : 11/150911
DATED : September 1, 2009
INVENTOR(S) : Dorber et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 961 days.

Signed and Sealed this

Fourteenth Day of September, 2010

David J. Kappos

David J. Kappos
*Director of the United States Patent and Trademark Office*